US007071428B1

(12) United States Patent
Bakker

(10) Patent No.: US 7,071,428 B1
(45) Date of Patent: Jul. 4, 2006

(54) SELF-ADJUSTING INTERLOCK ACTUATOR FOR A HINGED COVER

(75) Inventor: Johan P. Bakker, Livingston, MI (US)

(73) Assignee: Unisys Corporation, Blue Bell, PA (US)

( * ) Notice: Subject to any disclaimer, the term of this patent is extended or adjusted under 35 U.S.C. 154(b) by 49 days.

(21) Appl. No.: 11/012,847

(22) Filed: Dec. 14, 2004

(51) Int. Cl.
*H01H 3/16* (2006.01)

(52) U.S. Cl. ..... 200/61.7; 200/50.1

(58) Field of Classification Search ..... 200/61.58 R, 200/61.61, 61.7, 61.76, 50.1, 61.78, 61.81, 200/61.82, 50.01
See application file for complete search history.

(56) References Cited

U.S. PATENT DOCUMENTS 3,430,011 A * 2/1969 Skelton ..... 200/61.21
3,453,613 A * 7/1969 Kay ..... 200/61.81
4,262,176 A * 4/1981 Kapitza et al. ..... 200/61.43
5,153,395 A * 10/1992 Schantz et al. ..... 200/61.62
5,691,520 A * 11/1997 Hapke et al. ..... 200/61.62
5,726,402 A * 3/1998 Katz et al. ..... 200/61.7
6,118,090 A * 9/2000 Osvatic et al. ..... 200/61.76
6,653,581 B1 * 11/2003 Bassi ..... 200/61.62

* cited by examiner

*Primary Examiner*—Michael A. Friedhofer
(74) *Attorney, Agent, or Firm*—Lise A. Rode; Mark T. Starr; Brooks Kushman P.C.

(57) ABSTRACT

A self-adjusting interlock actuator assembly for a hinged cover is composed of a cover hinge attaching the cover to the apparatus and a pivoting switch actuator. A spring means connects the cover hinge to the pivoting switch actuator. The spring means is arranged such that the pivoting switch actuator is driven by the cover hinge via the spring means to actuate the interlock switch when the cover is closed. In this way, rotating the cover hinge about the hinge axis causes the pivoting switch actuator to rotate about its pivot axis, thereby causing the pivoting switch actuator to actuate the interlock switch.

20 Claims, 6 Drawing Sheets

SELF-ADJUSTING INTERLOCK ACTUATOR FOR A HINGED COVER

BACKGROUND OF THE INVENTION

1. Field of the Invention

The invention relates to products having operator-access covers which protect operators from dangerous machine elements (rotating hardware, moving parts, etc.) but which need to be regularly opened by operators for service access and maintenance.

2. Background Art

The use of an interlock actuator for an operator-access cover is required in certain applications. Such operator-access covers are required, as a matter of product design requirements and/or regulatory standards, to incorporate some automatic interlock feature which will de-energize any dangerous machine element when the cover is opened and render the exposed parts of the machine safe for operator access. Such interlock function is usually provided by an electrical switch or switches, which break the supply of electrical power to the exposed machinery and/or send a signal to the controlware of the machine, which in turn breaks the power supply and/or otherwise renders the machinery safe.

Such electrical switches are typically highly regulated as to type and construction by the regulatory agencies who specify interlock functions and certify compliance. Switches, for example, must typically be double-pole, of approved construction and contact separation, non-defeatable without the use of special tools (incapable of being "cheated") and self-resetting when overridden for service. One consequence of these regulatory requirements is that such switches typically have a very narrow range of motion in which they are guaranteed to operate. For example, a plunger switch may have a range of plunger motion in which the maker guarantees correct closed contact configuration of +/−0.015 inches.

Such operator-access covers are typically hinged to open and close. Workers in the art are aware of the great difficulty of mounting and configuring such switches to ensure reliable operation (given their narrow operating range) while still making covers, hinge systems and the like within normal manufacturing tolerances. It is very easy for normal manufacturing tolerances to accumulate through the various parts of the cover, hinges and switch mounts to the point where the operating range of the switch is exceeded by the possible range of tolerances in the various parts. For this reason, switches are often actuated through a separate adjustable actuator, which can be adjusted to compensate for tolerance accumulation.

Leaving aside the added cost, such adjustable actuators are less-than-desirable because it is virtually impossible to ensure that they are adjusted to actuate the switch fully. In other words, the actuator may be adjusted so that the switch is seen to work correctly (as tested by electrical measurement, for example) but there is no practical way to tell whether the switch is at one limit or the other of its operating range, and liable to fail at any time due to part variation, vibration or the slightest change in the intervening parts. Another problem is that of over-travel—where the actuator is adjusted so that it over-actuates the switch, causing unacceptable pressures on the switch assembly and poor fit or closure of the cover. Such switches and adjustable actuators are a continual source of service attention and unplanned downtime.

For the foregoing reasons, there is a need for an improved interlock actuator for a hinged cover.

SUMMARY OF THE INVENTION

It is an object of the invention to provide a self-adjusting interlock actuator for a hinged cover. In preferred embodiments of the invention, a hinged operator-access cover provides a self-adjusting actuator function which will always operate an interlock switch correctly and provides automatic force and travel limit functions which ensure that the switch is never over-actuated. Further, in preferred embodiments, these functions are provided in a way that is completely independent of variations in cover and hinge parts.

The invention involves a self-adjusting interlock actuator for a hinged cover. Such hinged covers are often used as operator-access covers which protect operators from dangerous machine elements but need to be regularly opened by operators for service and maintenance purposes. One place where such hinged covers are used is in document processing systems.

The self-adjusting interlock actuator assembly includes a cover hinge that attaches to the cover and defines a hinge axis. A pivoting switch actuator rotates, preferably on the same axis as the hinge axis, and is driven by the cover hinge via compliant spring means. The spring means provides adequate actuating force to actuate the interlock switch with the switch actuator when the cover is closed. It is preferred to configure the spring means such that the force on the switch cannot exceed a maximum permissible force regardless of cover position or manipulation.

Put another way, the cover hinge is rotated as the cover is rotated. The pivoting switch actuator rotates and is driven by a spring means connected to the cover hinge. In this way, the pivoting switch actuator is indirectly driven as opposed to being strictly fixed to the cover hinge. This indirect drive approach ensures that the interlock switch is operated correctly independent of variations in hinge and cover parts.

It is appreciated that the invention at the more detailed level comprehends additional features that are implemented in preferred embodiments of the invention. One such feature is a limit stop mechanism incorporated into the assembly which ensures that the switch can never be over-actuated regardless of cover or hinge position. Another such feature is to arrange the assembly such that the interconnection between the pivoting cover and pivoting switch actuator ensures that the switch opens before the cover is opened far enough to exceed regulatory limits, regardless of variations in cover and hinge parts, and that the cover always closes fully and completely regardless of variations in actuator or switch parts.

It is appreciated that in embodiments of the invention, self-adjusting interlock actuator assemblies may take many forms. The cover hinge, switch actuator and spring means may be implemented in various ways depending on the application provided that in the assembly, the pivoting switch actuator is indirectly driven via the spring means as the cover hinge is rotated.

Further, it is to be appreciated that it is preferred that the pivoting switch actuator rotates on the same axis as the hinge axis. However, in an alternative embodiment, it would be possible to have the pivoting switch actuator rotate about an axis that is offset from the hinge axis. Accordingly, the limit stop mechanism would need to be configured appropriately to accommodate the translation motion in addition to the rotation motion of the switch actuator with respect to the cover hinge.

DETAILED DESCRIPTION OF THE PREFERRED EMBODIMENT

Figure 1:
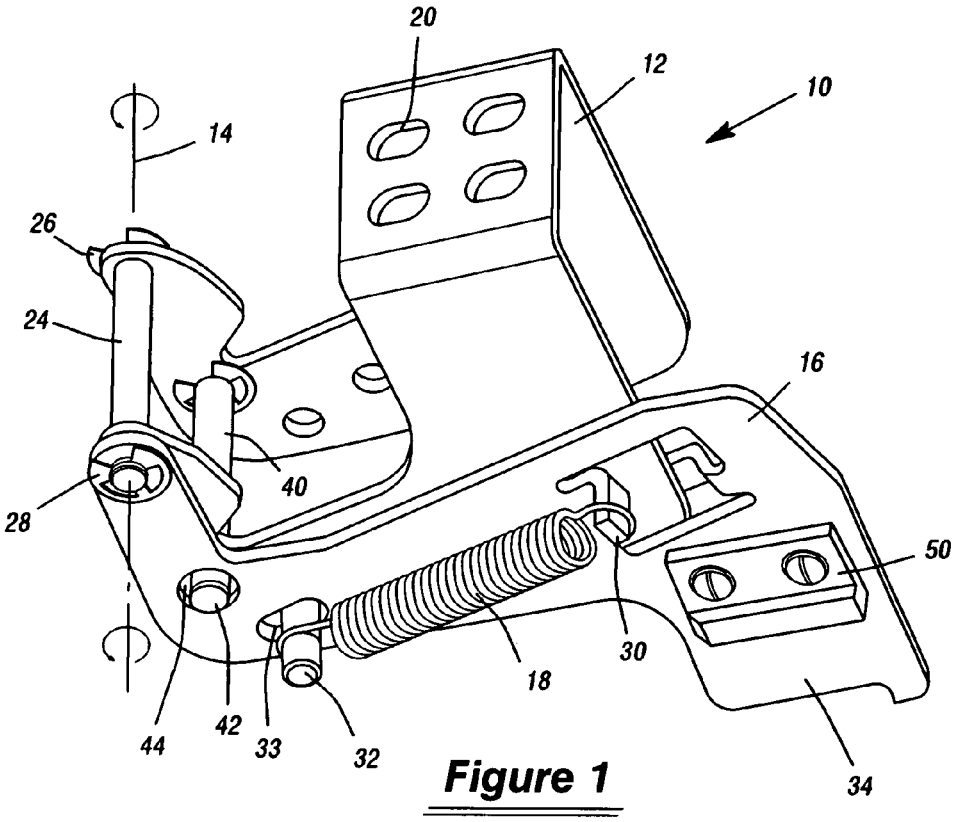
FIG. 1 is a perspective view of a self-adjusting interlock actuator for a hinged cover made in accordance with the invention, showing the pivotable switch actuator biased by the spring to the fully advanced position.
Figure 2:
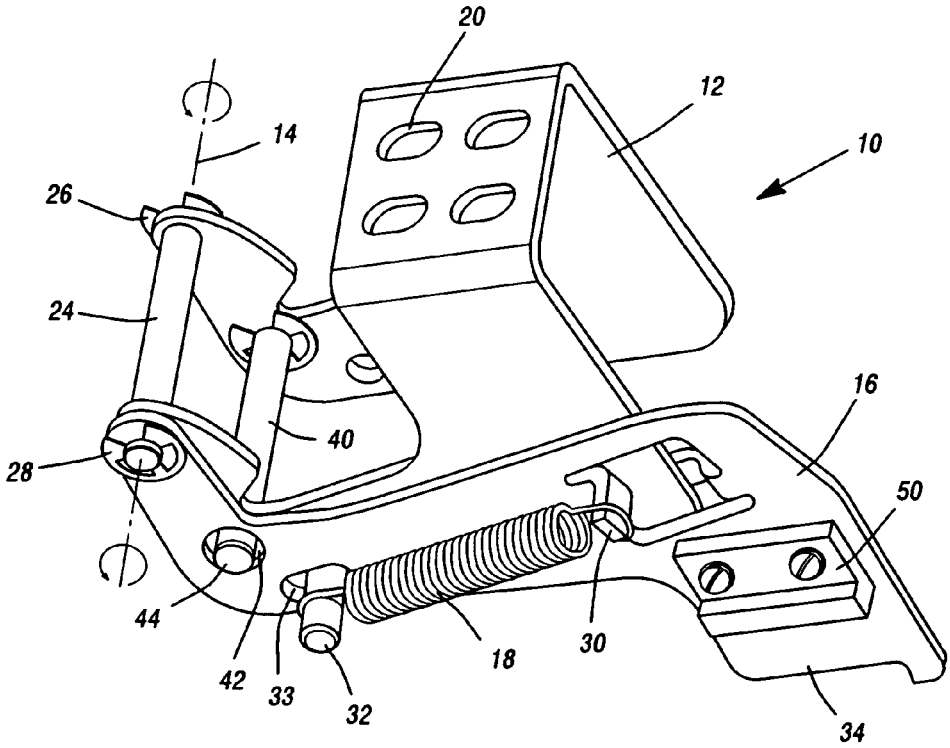
FIG. 2 is another perspective view of the self-adjusting interlock actuator, showing the pivotable switch actuator moved to the fully retracted position against the bias of the spring.
Figure 3:
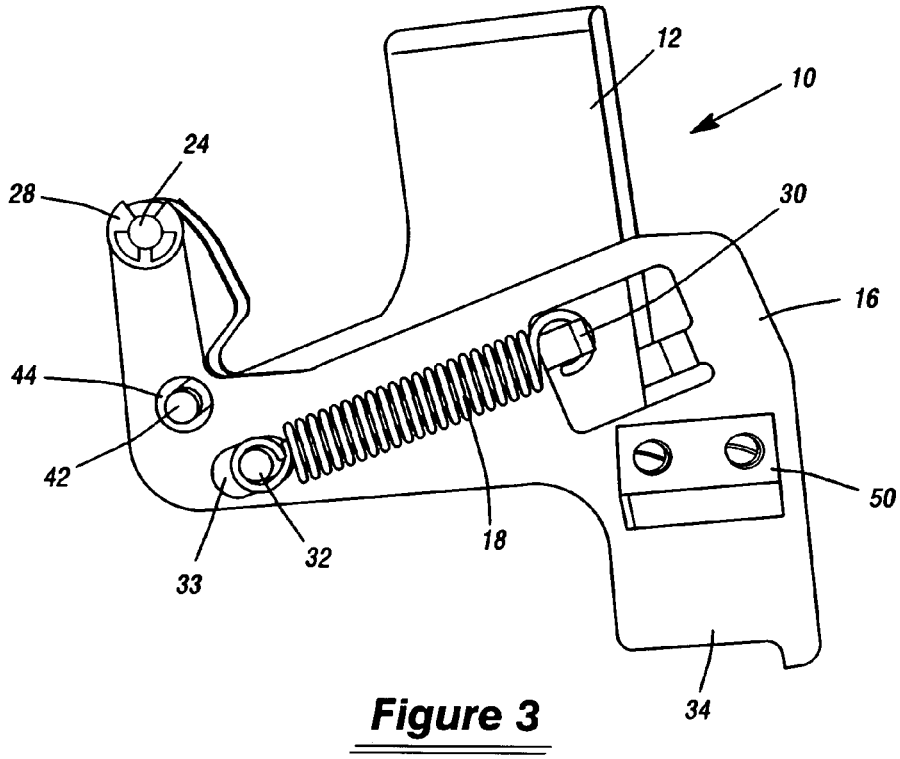
FIG. 3 is side view of the self-adjusting interlock actuator.
Figure 4:
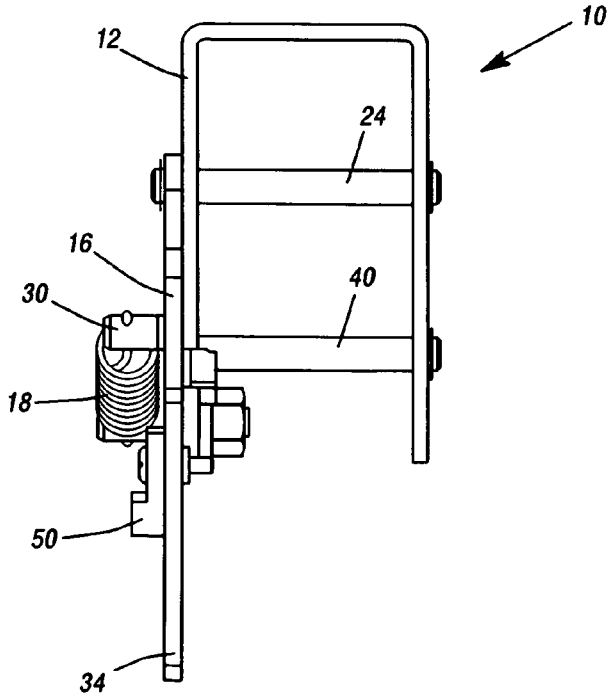
FIG. 4 is a front end view of the self-adjusting interlock actuator.
Figure 5:
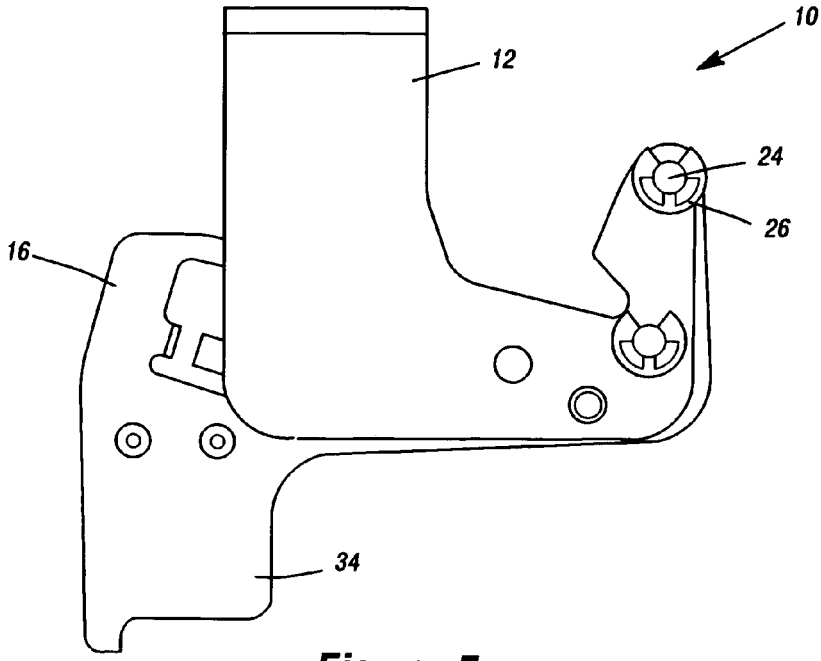
FIG. 5 is a back side view of the self-adjusting interlock actuator.
Figure 6:
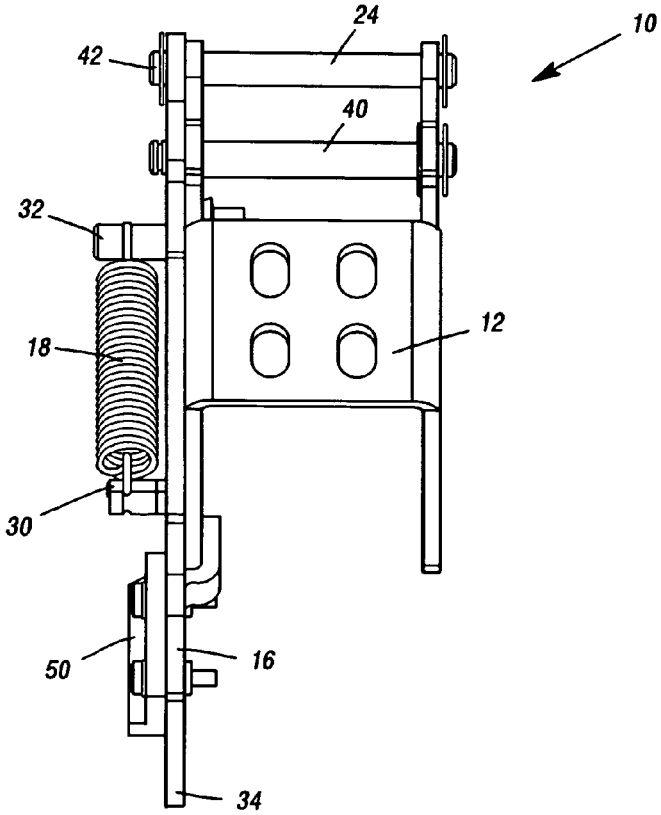
FIG. 6 is a top view of the self-adjusting interlock actuator.
Figure 7:
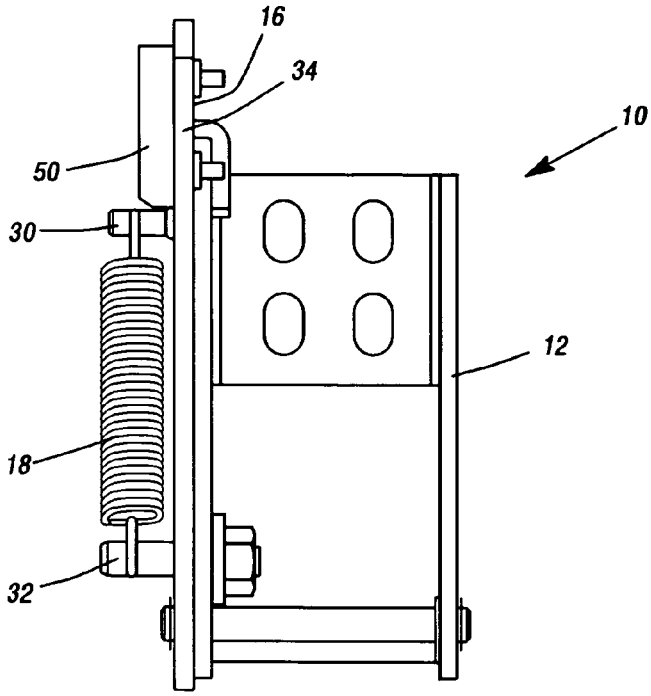
FIG. 7 is a bottom view of the self-adjusting interlock actuator.
Figure 8:
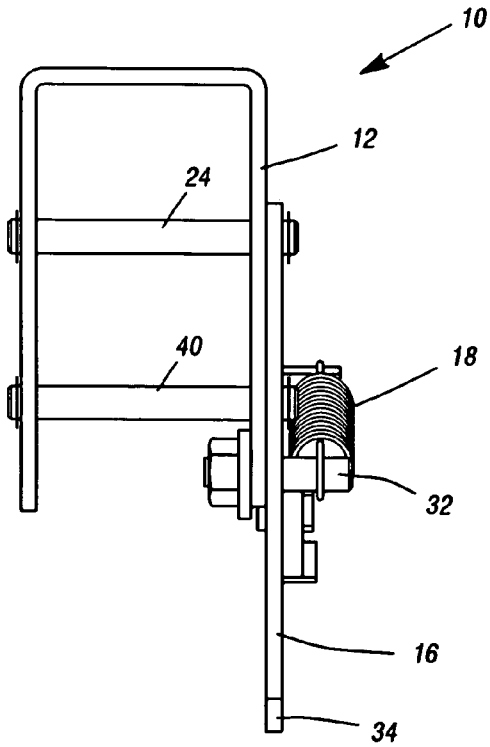
FIG. 8 is a rear end view of the self-adjusting interlock actuator.

FIGS. 1–8 illustrate various views of a self-adjusting interlock actuator assembly 10. As best shown in FIGS. 1–3, assembly 10 includes a cover hinge 12. Assembly 10 is utilized in an apparatus having a hinged operator-access cover which protects operators from machine elements and cooperates with an interlock switch to disable machine elements when the cover is opened. Cover hinge 12 attaches the cover to the apparatus, and defines a hinge axis 14 for the cover. The cover would attach at mount locations 20. Assembly 10 is further composed of pivoting switch actuator 16. The switch actuator 16 rotates about a pivot axis with respect to the apparatus. As shown, both cover hinge 12 and switch actuator 16 pivot about axis 14. In this illustrated embodiment, the spring means takes the form of spring 18, which connects cover hinge 12 to switch actuator 16.

The parts pivot about pin 24 which is secured by clips 26 and 28. Switch actuator 16 includes flange 30 to which one end of spring 18 is affixed. Pin 32 is secured to cover hinge 12, and extends through slot 33 in switch actuator 16. The other end of spring 18 is affixed to pin 32. Spring 18 is under tension when affixed between flange 30 and pin 32. In this way, spring 18 biases switch actuator 16 in the cover closing direction.

In FIG. 1, pivotable switch actuator 16 is shown being biased by spring 18 to the fully advanced position. Assembly 10 includes a limit stop mechanism to prevent over-actuation of the interlock switch by limiting rotation of pivoting switch actuator 16. Pin 40 is secured to cover hinge 12, and end 42 of pin 40 extends through slot 44 in switch actuator 16. This pin and slot arrangement restricts movement of the pivoting switch actuator 16 with respect to the cover hinge 12. In FIG. 1, the fully advanced position of switch actuator 16 occurs when pin end 42 limits the motion of switch actuator 16. In the same way, and as shown in FIG. 2, the fully retracted position of switch actuator 16 occurs when pin end 42 limits movement of switch actuator 16 in the cover opening direction.

When the cover is closed, pivoting switch actuator 16 is driven by cover hinge 12 via spring 18 to actuate the interlock switch with end 34 of switch actuator 16 when the cover is closed. More specifically, rotating cover hinge 12 about hinge axis 14 causes pivoting switch actuator 16 to rotate about axis 14, thereby causing pivoting switch actuator 16 to actuate the interlock switch with end 34. Also shown, redundant switch element 50 may be provided such that element 50 engages a mating element when the cover is closed, providing an additional switch that indicates when the cover is closed.

Figure 9:
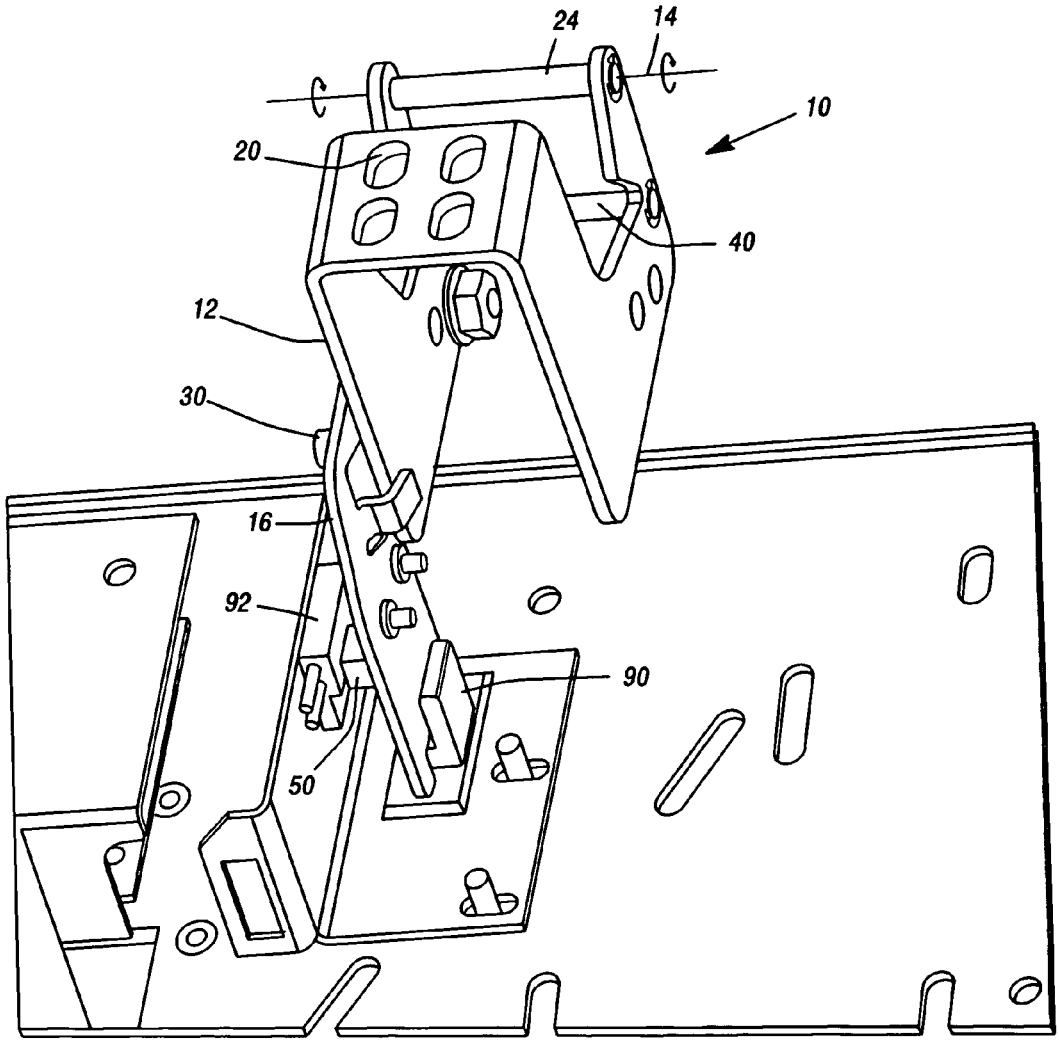
FIG. 9 is a perspective view of the self-adjusting interlock actuator showing the switch actuator engaging a switch.

FIG. 9 is a perspective view showing switch actuator 16 engaging a switch 90. Element 50 is shown engaging a redundant switch 92. In FIG. 9, cover hinge 12 is moved to the closed position, and the spring causes pivoting switch actuator 16 to rotate about axis 14, thereby resulting in the actuation of interlock switch 90 and redundant switch 92.

Figure 10:
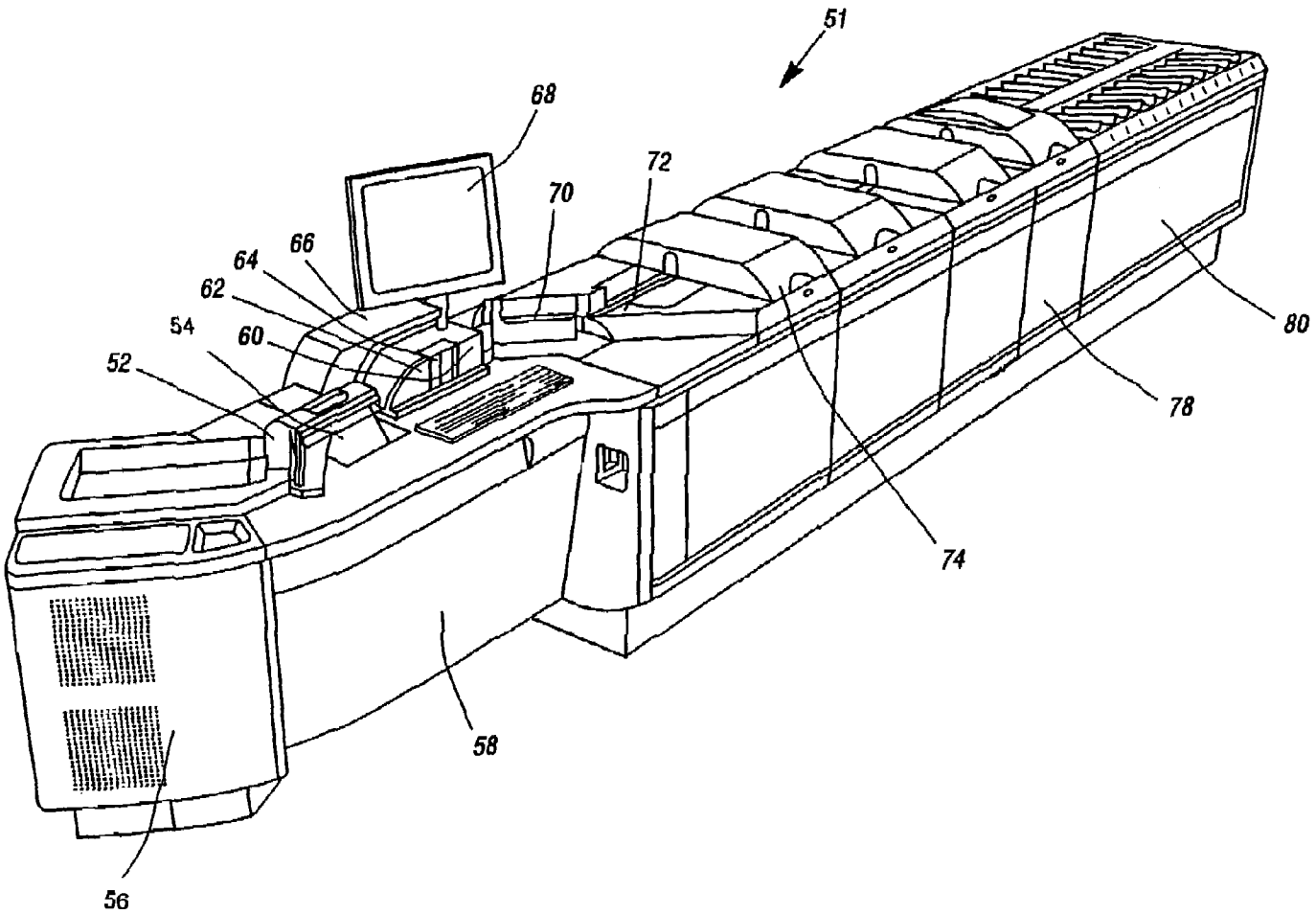
FIG. 10 illustrates a document processing system for feeding and transporting documents.

FIG. 10 illustrates a document processing system for feeding and transporting documents at 51. System 51 includes a primary feeder 52 and secondary feeder 54. Cabinet 56 houses a computer running software for system 51. System 51 further includes removable kneewell panel 58. The feeders act to separate and feed documents singly, in order, from a stack. The remainder of the system is the transporting portion of the system, which includes a number of roller pairs and/or belts to convey the documents, one at a time, through a track past other processing devices that perform operations on the documents.

As shown in FIG. 10, a number of processing devices are located in the transporting portion of the system 51. Magnetic ink character recognition (MICR) reader 60 and optical character recognition (OCR) reader 62 are located in the document track following secondary feeder 54. As well, upstream imaging devices 64 and 66 image each passing document. The operator display is indicated at 68.

With continuing reference to FIG. 10, system 51 further includes a post-read view station 70, and a low-speed document encoder 72. As well, a multi-jet endorser (MJE) is located at 74. Further down the document track, an amount-only or full-field high-speed encoder 76 and downstream imager 78 process the passing documents. Finally, a 12-pocket stacker module 80 is provided for the actual sorting of the documents into pockets. The drawing illustrates the preferred embodiment, which is depicted as an NDP Quantum Series transport available from Unisys.

In accordance with the invention, system 51 may have any number of hinged operator-access covers which protect operators from machine elements and cooperate with an interlock switch to disable machine elements when the cover is opened. Assembly 10 may be utilized at any of these covers. For example, various processing devices along the document track may include covers where a self-adjusting interlock actuator assembly 10 may be incorporated.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In combination with an apparatus having a hinged operator-access cover which protects operators from machine elements and cooperates with an interlock switch to disable machine elements when the cover is opened, the improvement comprising:

a self-adjusting interlock actuator assembly composed of a cover hinge attaching the cover to the apparatus and defining a hinge axis for the cover, a pivoting switch actuator having a pivot axis with respect to the apparatus, and a spring means connecting the cover hinge to the pivoting switch actuator;

wherein the spring means is arranged such that the pivoting switch actuator is driven by the cover hinge via the spring means to actuate the interlock switch when the cover is closed, whereby rotating the cover hinge about the hinge axis causes the pivoting switch actuator to rotate about the pivot axis thereby causing the pivoting switch actuator to actuate the interlock switch.

2. The combination of claim 1 wherein the hinge axis and the pivot axis are the same axis.

3. The combination of claim 1 further comprising:

a limit stop mechanism incorporated into the self-adjusting interlock actuator assembly to prevent over-actuation of the interlock switch by limiting rotation of the pivoting switch actuator.

4. The combination of claim 3 wherein the limit stop mechanism includes a pin and slot arrangement that restricts movement of the pivoting switch actuator with respect to the cover hinge.

5. The combination of claim 4 wherein the hinge axis and the pivot axis are the same axis.

6. The combination of claim 1 wherein the spring means is affixed on one end to the cover hinge and affixed on the other end to the pivoting switch actuator, the spring means biasing the pivoting switch actuator in the cover closing direction.

7. The combination of claim 6 wherein the spring means is under tension when installed in the assembly.

8. The combination of claim 7 further comprising:

a limit stop mechanism incorporated into the self-adjusting interlock actuator assembly to prevent over-actuation of the interlock switch by limiting rotation of the pivoting switch actuator.

9. The combination of claim 8 wherein the limit stop mechanism includes a pin and slot arrangement that restricts movement of the pivoting switch actuator with respect to the cover hinge.

10. The combination of claim 9 wherein the hinge axis and the pivot axis are the same axis.

11. An apparatus comprising:

a document processing system including a feeder stage and a transport stage;

the feeder stage including a hopper assembly and a feeder wherein the feeder acts to feed documents singly, in order, from a stack of documents in the hopper assembly;

the transport stage being downstream of the feeder stage for receiving the fed documents;

the document processing system including a plurality of machine elements;

a hinged operator-access cover which protects operators from at least one machine element and cooperates with an interlock switch to disable the at least one machine element when the cover is opened;

a self-adjusting interlock actuator assembly composed of a cover hinge attaching the cover to the system and defining a hinge axis for the cover, a pivoting switch actuator having a pivot axis with respect to the system, and a spring means connecting the cover hinge to the pivoting switch actuator;

wherein the spring means is arranged such that the pivoting switch actuator is driven by the cover hinge via the spring means to actuate the interlock switch when the cover is closed, whereby rotating the cover hinge about the hinge axis causes the pivoting switch actuator to rotate about the pivot axis thereby causing the pivoting switch actuator to actuate the interlock switch.

12. The apparatus of claim 11 wherein the hinge axis and the pivot axis are the same axis.

13. The apparatus of claim 11 further comprising:

a limit stop mechanism incorporated into the self-adjusting interlock actuator assembly to prevent over-actuation of the interlock switch by limiting rotation of the pivoting switch actuator.

14. The apparatus of claim 13 wherein the limit stop mechanism includes a pin and slot arrangement that restricts movement of the pivoting switch actuator with respect to the cover hinge.

15. The apparatus of claim 14 wherein the hinge axis and the pivot axis are the same axis.

16. The apparatus of claim 11 wherein the spring means is affixed on one end to the cover hinge and affixed on the other end to the pivoting switch actuator, the spring means biasing the pivoting switch actuator in the cover closing direction.

17. The apparatus of claim 16 wherein the spring means is under tension when installed in the assembly.

18. The apparatus of claim 17 further comprising:

a limit stop mechanism incorporated into the self-adjusting interlock actuator assembly to prevent over-actuation of the interlock switch by limiting rotation of the pivoting switch actuator.

19. The apparatus of claim 18 wherein the limit stop mechanism includes a pin and slot arrangement that restricts movement of the pivoting switch actuator with respect to the cover hinge.

20. The apparatus of claim 19 wherein the hinge axis and the pivot axis are the same axis.

* * * * *